US010343809B2

(12) United States Patent
Knutson et al.

(10) Patent No.: US 10,343,809 B2
(45) Date of Patent: Jul. 9, 2019

(54) COMPARTMENTALIZED CONTAINERS

(71) Applicant: Inline Plastics Corp., Shelton, CT (US)

(72) Inventors: Herb Knutson, Waterbury, CT (US); Sarah Hobson, Shelton, CT (US); Irene Makarchuk, Fairfield, CT (US); Teddy Lozowski, Milford, CT (US)

(73) Assignee: Inline Plastics Corp., Shelton, CT (US)

( * ) Notice: Subject to any disclaimer, the term of this patent is extended or adjusted under 35 U.S.C. 154(b) by 191 days.

(21) Appl. No.: 15/427,482

(22) Filed: Feb. 8, 2017

(65) Prior Publication Data

US 2018/0222623 A1 Aug. 9, 2018

(51) Int. Cl.

| | |
|---|---|
| ***B65D 1/36*** | (2006.01) |
| ***B65D 21/02*** | (2006.01) |
| ***B65D 43/02*** | (2006.01) |
| ***B65D 51/18*** | (2006.01) |

(52) U.S. Cl.

CPC ..... *B65D 1/36* (2013.01); *B65D 21/0222* (2013.01); *B65D 43/021* (2013.01); *B65D 43/0254* (2013.01); *B65D 51/18* (2013.01); *B65D 2101/0092* (2013.01); *B65D 2251/0018* (2013.01); *B65D 2251/0081* (2013.01); *B65D 2543/0062* (2013.01); *B65D 2543/00092* (2013.01); *B65D 2543/00101* (2013.01); *B65D 2543/00194* (2013.01); *B65D 2543/00296* (2013.01); *B65D 2543/00324* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01); *B65D 2543/00944* (2013.01); *B65D 2577/2075* (2013.01)

(58) Field of Classification Search

CPC .... B65D 1/36; B65D 43/021; B65D 21/0222; A47J 47/02

See application file for complete search history.

(56) References Cited

U.S. PATENT DOCUMENTS

| | | | | |
|---|---|---|---|---|
| 3,561,668 A * | 2/1971 | Bergstrom | ..... | B65B 7/01 215/227 |
| 5,022,551 A * | 6/1991 | Hexel | ..... | B65D 1/36 220/270 |
| 5,040,695 A * | 8/1991 | Adams | ..... | B65D 17/04 220/266 |
| 5,419,451 A * | 5/1995 | Bitel, Jr. | ..... | B65D 1/36 206/508 |

(Continued)

FOREIGN PATENT DOCUMENTS

EP 0677454 A1 10/1995

*Primary Examiner* — Jeffrey R Allen

(74) *Attorney, Agent, or Firm* — McCarter & English, LLP; David J. Silvia

(57) ABSTRACT

A container includes a base defining a perimeter opening and a top surface within the perimeter opening. The top surface includes a plurality of discrete openings defining respective compartments extending downwardly from the top surface of the base. A first reclosable lid covers the perimeter opening when the container is closed to resist transfer of solid matter between the compartments of the base. An additional reclosable lid encloses one of the compartments to resist liquid from exiting the compartment when the compartment is closed.

19 Claims, 4 Drawing Sheets

(56) References Cited

U.S. PATENT DOCUMENTS

| | | | | |
|---|---|---|---|---|
| 6,015,064 | A | 1/2000 | Liu | |
| 8,523,000 | B2 | 9/2013 | Vovan | |
| 8,973,776 | B1 | 3/2015 | Buck | |
| 10,000,303 | B2 * | 6/2018 | Malcolm | B65B 51/10 |
| 2007/0228047 | A1 | 10/2007 | Pehr et al. | |
| 2010/0320212 | A1 * | 12/2010 | Cai | A47J 47/02 220/526 |

* cited by examiner

COMPARTMENTALIZED CONTAINERS

BACKGROUND OF THE INVENTION

1. Field of the Invention

The subject invention is directed to containers and packaging, and more particularly, to containers and packaging that incorporate multiple compartments.

2. Background of the Related Art

Disposable containers for packaging, distributing, displaying or otherwise housing consumer items are widely used. The advent of plastics resulted in many products being wrapped or packaged in plastic, both in the form of flexible plastic bags and rigid plastic containers. The use of plastics in the modern-day convenience food industry has significantly improved the "shelf life" of perishable products, allowing both merchants and their customers to store the products for longer periods of time, resulting in substantial savings.

It has been found that consumers like reclosable packages, particularly for comestible products, especially in circumstances where more than one serving of a comestible product is contained therein, in order to reduce drying out or other deterioration of the comestible food product. Traditional single compartment reclosable containers have been considered satisfactory for their intended purpose. However, it is desirable to fabricate improved reclosable containers with multiple compartments. Accordingly, the present invention is directed to a container that meets these needs.

SUMMARY OF THE DISCLOSURE

The present disclosure is directed to a compartmentalized container. The container includes a base defining a perimeter opening and a top surface within the perimeter opening. The top surface includes a plurality of discrete openings defining respective compartments extending downwardly from the top surface of the base. A first reclosable lid covers the perimeter opening when the container is closed to resist transfer of solid matter between the compartments of the base. An additional reclosable lid encloses one of the compartments to resist liquid from exiting that compartment when the compartment is closed.

In some embodiments, a bottom surface of the first reclosable lid abuts the top surface of the base. The first reclosable lid can terminate in an outwardly extending peripheral flange. A portion of the top surface of the first reclosable lid can be recessed with respect to the outwardly extending peripheral flange of the first reclosable lid. The top surface of the base can include an upper peripheral rim. A bottom surface of the outwardly extending peripheral flange of the first reclosable lid can abut the upper peripheral rim of the top surface of the base. A portion of the top surface of the first reclosable lid can be recessed within the perimeter opening of the base with respect to the upper peripheral rim of the base. The perimeter opening of the base can include a peripheral locking shoulder and the first reclosable lid can include an outwardly tapered shoulder. The outwardly tapered shoulder can engage the peripheral locking shoulder to form a non-permanent press-fit engagement between the base and the first reclosable lid when the container is closed. A top surface of the first reclosable lid can include ribs raised with respect to the top surface of the first reclosable lid to assist with stacking containers together.

In accordance with some embodiments, a bottom surface of the peripherally extending flange of the additional reclosable lid abuts the top surface of the base around the entire perimeter of that compartment. A portion of the top surface of the additional lid can be recessed within the compartment with respect to the top surface of the base. The additional reclosable lid can include a peripherally extending flange. The bottom surface of the first reclosable lid can abut a top surface of the peripherally extending flange of the additional reclosable lid when the container is closed. A perimeter of the compartment covered by the additional reclosable lid can include a peripheral locking shoulder. The additional reclosable lid can include an outwardly tapered shoulder. The outwardly tapered shoulder of the additional reclosable lid can engage the peripheral locking shoulder of the compartment to form a non-permanent press-fit engagement between the compartment and the additional reclosable lid when the compartment is closed. The additional reclosable lid can be one of a plurality of additional reclosable lids. Each of the plurality of additional reclosable lids can enclose a respective compartment.

In some embodiments, the top surface of the base includes a detent proximate to the peripherally extending flange of the additional reclosable lid to facilitate access to a portion of the bottom surface of the peripherally extending flange of the additional reclosable lid. The shape of the detent can vary as may be desired. The detent can be circular, shovel-shaped (as shown in the Figures), or the like. The detent in the top surface of the base can be offset from edges of the discrete openings. In accordance with some embodiments, there are four discrete openings. The detent can be positioned in the top surface of the base between the four discrete openings offset from edges of each of the discrete openings.

The compartmentalized container can include a tamper-evident hinge joining the first reclosable lid with the base. The tamper-evident hinge can include a frangible section. The frangible section can include at least one line of weakness. In accordance with some embodiments, the frangible section includes two parallel lines of weakness defining a tear strip therebetween. The first reclosable lid and the base can be thermoformed from a single sheet of plastic.

These and other unique features of embodiments of the present invention will become more readily apparent from the following description and the accompanying drawings.

BRIEF DESCRIPTION OF THE DRAWINGS

So that those skilled in the art to which the subject disclosure appertains will readily understand how to make and use the articles and methods of the subject disclosure without undue experimentation, embodiments thereof will be described in detail herein below with reference to certain figures, wherein.

DETAILED DESCRIPTION OF THE PREFERRED EMBODIMENTS

Figure 1:
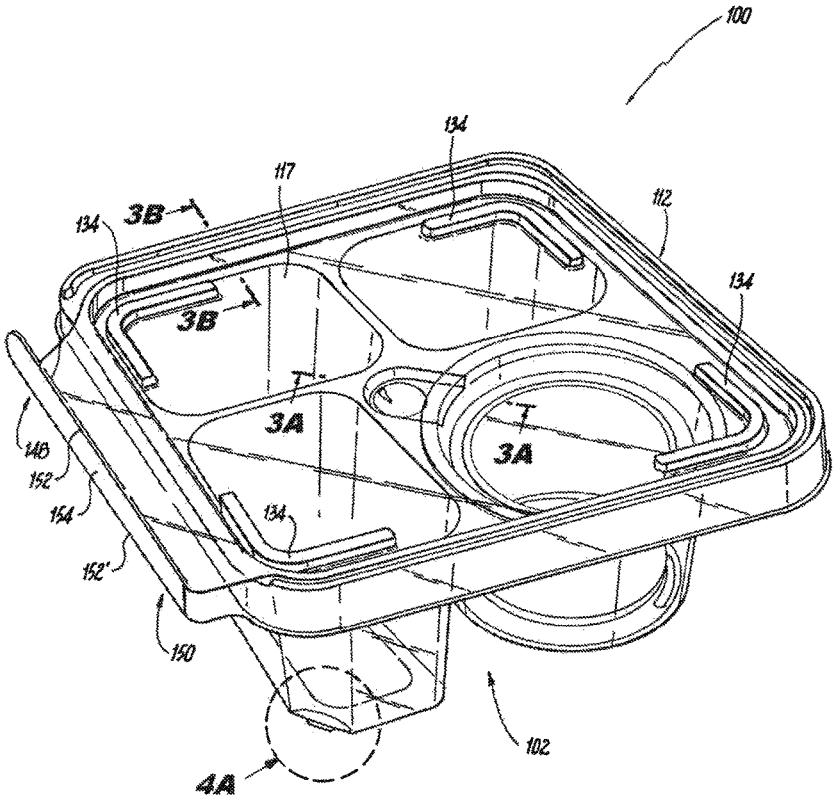
FIG. 1 is a perspective view of a reclosable compartmentalized, tamper-resistant and tamper-evident container constructed in accordance with the present invention having a first reclosable lid and a base.

Reference will now be made to the drawings wherein like reference numerals identify similar structural features or aspects of the subject disclosure. For purposes of explanation and illustration, and not limitation, a perspective view of an exemplary embodiment of a compartmentalized container 100 in accordance with the disclosure is shown in FIG. 1 and is designated generally by reference character 100. Other embodiments of compartmentalized container 100 in accordance with the disclosure, or aspects thereof, are provided in FIGS. 2-4, as will be described.

As shown in FIG. 1, an embodiment of reclosable compartmentalized container 100 is shown. Container 100 includes base 102 and a first reclosable lid 112. First reclosable lid 112 encloses the contents of container 100. It is contemplated that first reclosable lid 112 and base 102 are thermoformed from a single sheet of plastic. Compartmentalized container 100 includes a tamper-evident hinge 148 joining first reclosable lid 112 with base 102. Tamper-evident hinge 148 includes a frangible section 150. Frangible section 150 includes two parallel lines of weakness 152 and 152' defining a tear strip 154 therebetween. It is contemplated that one line of weakness or any number of lines of weakness can be used. Top surface 117 of first reclosable lid 112 includes ribs 134 raised with respect to top surface 117 of first reclosable lid 112 to assist with stacking multiple containers 100 together. Ribs 134 are arranged proximate the periphery of container 100 in corners opposite from one another.

Figure 2:
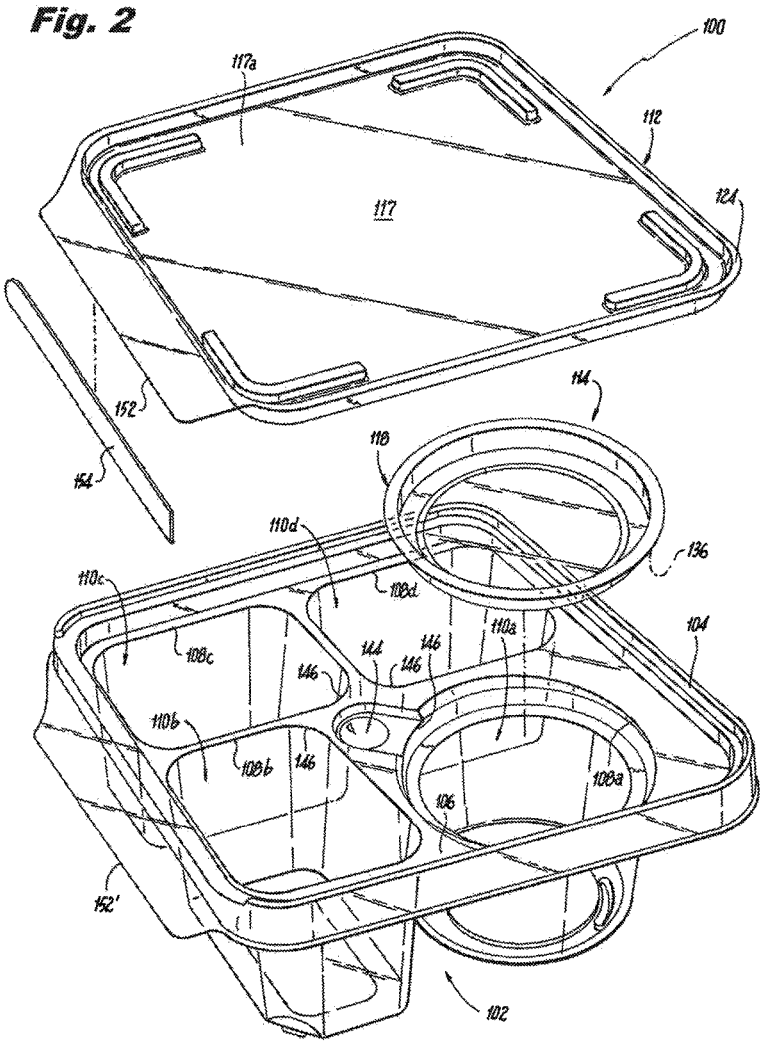
FIG. 2 is an exploded perspective view of the container of FIG. 1, showing a plurality of compartments and an additional reclosable lid.

With reference now to FIG. 2, base 102 defines a perimeter opening 104 and a top surface 106 within perimeter opening 104. Top surface 106 includes a plurality of discrete openings 108*a*-108*d* defining respective compartments 110*a*-110*d* extending downwardly from top surface 106 of base 102. First reclosable lid 112 covers perimeter opening 104 when container 100 is closed to resist transfer of solid matter between compartments 110 of base 102 and to prevent unwanted transfer of matter, solid or otherwise, outside of container 100. First reclosable lid 112 terminates in an outwardly extending peripheral flange 124. A portion 117*a* of the top surface 117 of first reclosable lid 112 is recessed with respect to outwardly extending peripheral flange 124 of first reclosable lid 112.

With continued reference to FIG. 2, in this embodiment, an additional reclosable lid 114 encloses one of compartments 110, e.g. compartment 110*a*, to resist liquid or other contents from exiting compartment 110*a* when compartment 110*a* is closed by additional lid 114. While embodiments of container 100 are shown herein as having only a single compartment 110*a* enclosed by a single additional lid 114, it is contemplated that multiple compartments 110 within container 100 can be constructed similar to compartment 110*a* and have respective lids comparable to additional lid 114 to resist liquid or other contents from exiting, e.g. container 100 can include multiple additional lids similar to additional lid 114. It is also contemplated that, in accordance with some embodiments, a single additional lid 114 could enclose more than one of compartments 110.

With multiple compartments 110 in a single container 100, it is possible to store multiple types of products, e.g. comestible products, in a single container without unwanted co-mingling between the products. Moreover, by having both first and additional lids 112 and 114, respectively, reclosable, a consumer can reduce drying out or other deterioration of the comestible food product even after the container 100 and compartment 110*a* have been initially opened and still reduce unwanted co-mingling between the products.

Figure 3A:
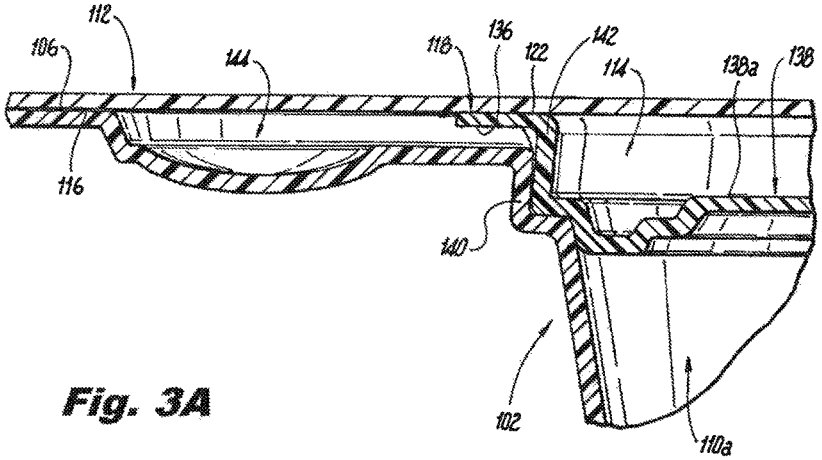
FIG. 3A is a side elevation view of a cross-section of a portion of the container of FIG. 1, showing the first and additional reclosable lids in a closed position.

As shown in FIG. 2, additional reclosable lid 114 includes a peripherally extending flange 118. Top surface 106 of the base 102 includes a detent 144. Detent 144 in top surface 106 of base 102 is offset from edges of discrete openings 108. In the embodiment of FIG. 2, detent 144 is positioned in top surface 106 of base 102 between four discrete openings 108 offset from edges 146 of each of discrete openings 108. When additional reclosable lid 114 is closed over compartment 110*a*, as shown in FIG. 3A, detent 144 is proximate to peripherally extending flange 118 of additional reclosable lid 114 to provide access to a portion of bottom surface 136 of peripherally extending flange 118 of additional reclosable lid 114. The detent 144 can be any shape which facilitates access to a portion of bottom surface 136 of peripherally extending flange 118 of additional reclosable lid 114. Thus, the detent 144 can be circular, shovel-shaped (as shown) or any other shape which permits access to flange 118 to facilitate removal of reclosable lid 114.

Figure 3B:
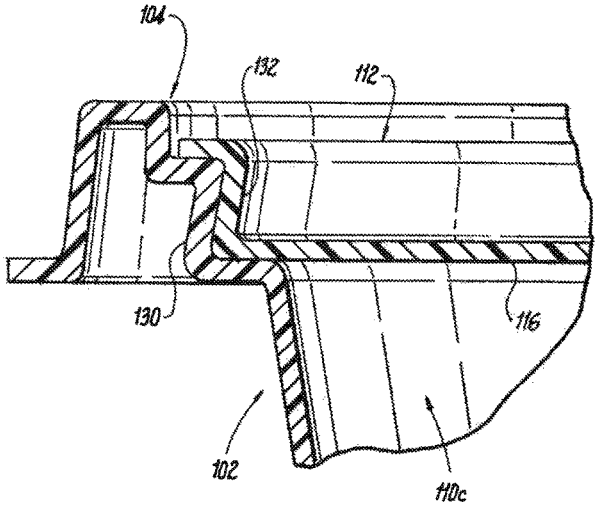
FIG. 3B is a side elevation view of a cross-section of a portion of the container of FIG. 2, showing the engagement between the peripheral locking shoulder of the base and the outwardly tapered shoulder of the first reclosable lid.

As shown in FIGS. 3A and 3B, when closed, a bottom surface 116 of first reclosable lid 112 abuts top surface 106 of base 102, thereby resisting transfer of solid matter between compartments 110 of base 102. Bottom surface 116 of first reclosable lid 112 abuts a top surface 122 of peripherally extending flange 118 of additional reclosable lid 114. Perimeter opening 104 of base 102 includes a peripheral locking shoulder 130 and first reclosable lid 112 includes an outwardly tapered shoulder 132. Outwardly tapered shoulder 132 engages peripheral locking shoulder 130 to form a non-permanent press-fit engagement between base 102 and first reclosable lid 112 when container 100 is closed.

With continued reference to FIGS. 3A and 3B, a bottom surface 136 of peripherally extending flange 118 of additional reclosable lid 114 abuts top surface 106 of base 102 around the entire perimeter of compartment 110*a*. A portion 138*a* of top surface 138 of additional lid 114 is recessed within compartment 110*a* with respect to top surface 106 of base 102. A perimeter of compartment 110*a* covered by additional reclosable lid 114 includes a peripheral locking shoulder 140. Additional reclosable lid 114 includes an outwardly tapered shoulder 142. The outwardly tapered shoulder 142 of additional reclosable lid 114 engages peripheral locking shoulder 140 of compartment 110*a* to form a non-permanent press-fit engagement between compartment 110*a* and additional reclosable lid 114 when compartment 110*a* is closed thereby resisting liquid or other contents from exiting compartment 110*a* when compartment 110*a* is closed by additional lid 114.

It has been observed that when the first reclosable lid 112 is snapped in place on the base 102 in the closed position, there is a tendency for the top surface 117 of lid 112 to bow due to the pressure exerted thereon from the seal that is effected. This bowing mitigates against the anti-migration effect caused by the seal between the bottom surface of the first reclosable lid 112 and the top surface 106 of base 102, especially with respect to smaller particles. This bowing tendency can be overcome by providing a domed surface 146 to the top surface 106 of base 102 as shown in FIG. 4B.

Figure 4A:
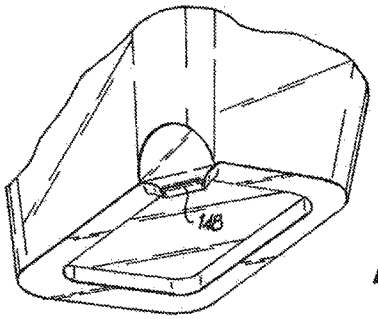
FIG. 4A is a perspective view of the underside of a compartment of the container illustrating an embodiment containing chamfered corners of the compartments.
Figure 4B:
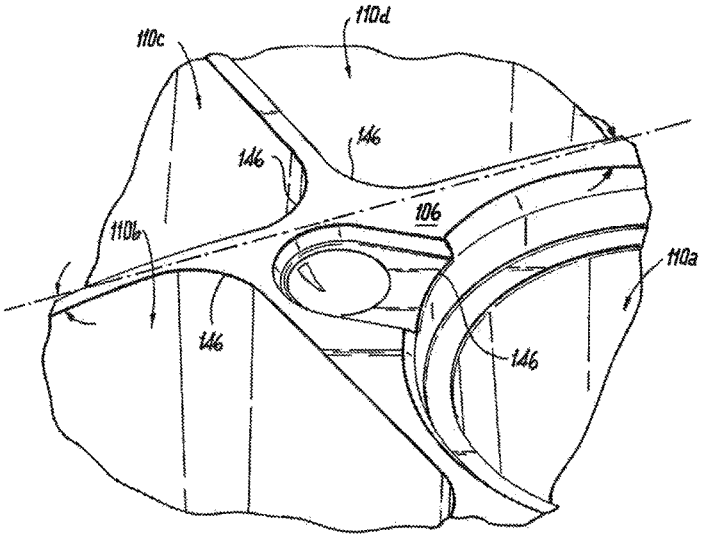
FIG. 4B is a perspective view of a portion of the top of the container base illustrating an embodiment of the container wherein the top surface of the base is domed to mitigate against bowing.

Additionally, if desired, the stability of the stack, when the containers of the present invention are place on top of each other for shipment or storage, can be improved if one or more of the bottom corners 148 of the respective compartments 108*a*-108*d* are chamfered as shown in FIG. 4A.

Those skilled in the art will readily appreciate that container 100 can be made from a variety of suitable materials such as, resins or plastic materials such as polyethylene, polypropylene, polyvinyl chloride or polyethylene terephthalate ("PETE"), as well as other suitable materials or combinations thereof, metallic materials, and/or paper materials. These materials can be transparent, translucent or opaque. It is also contemplated that the container can be made in a variety of colors.

The methods and systems of the present disclosure, as described above and shown in the drawings, provide for containers with superior properties including multiple compartments within a single container that can be individually sealed, allowing multiple comestible products to be stored in the same container without unwanted co-mingling between the products. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A compartmentalized container comprising:

a base defining a perimeter opening and a top surface within the perimeter opening, wherein the top surface includes a plurality of discrete openings defining respective compartments extending downwardly from the top surface of the base;

the perimeter opening defining a first sealing surface including a first peripheral locking shoulder and at least one of the compartments defining a second sealing surface including a second peripheral locking shoulder;

a first reclosable lid including a first lid shoulder for corresponding non-permanent press-fit engagement with the first peripheral locking shoulder, the first reclosable lid is configured to cover the perimeter opening when the container is closed to resist transfer of contents between the compartments of the base; and an additional reclosable lid including a second lid shoulder for corresponding non-permanent press-fit engagement with the second peripheral shoulder of the one of the compartments, the additional reclosable lid is configured to enclose the compartment to resist contents from exiting the compartment when the compartment is closed.

2. The compartmentalized container as recited in claim 1, wherein the bottom surface of the first reclosable lid abuts the top surface of the base.

3. The compartmentalized container as recited in claim 2, wherein the top surface of the base is domed.

4. The compartmentalized container as recited in claim 1, wherein the additional reclosable lid includes a peripherally extending flange, wherein a bottom surface of the peripherally extending flange of the additional reclosable lid abuts the top surface of the base around the entire perimeter of the compartment.

5. The compartmentalized container as recited in claim 1, wherein a portion of a top surface of the additional lid is recessed within the compartment with respect to the top surface of the base.

6. The compartmentalized container as recited in claim 1, wherein a bottom surface of the first reclosable lid abuts a top surface of a peripherally extending flange when the container is closed.

7. The compartmentalized container as recited in claim 1, wherein the top surface of the base includes a detent proximate to a peripherally extending flange of the additional reclosable lid to provide access to a portion of a bottom surface of the peripherally extending flange of the additional reclosable lid.

8. The compartmentalized container as recited in claim 7, wherein the detent in the top surface of the base is offset from the edges of the discrete openings.

9. The compartmentalized container as recited in claim 8, wherein the plurality of discrete openings includes four openings, wherein the detent is positioned in the top surface of the base between the four discrete openings offset from edges of each of the discrete openings.

10. The compartmentalized container as recited in claim 1, wherein the first reclosable lid terminates in an outwardly extending peripheral flange, wherein a portion of a top surface of the first reclosable lid is recessed with respect to the outwardly extending peripheral flange.

11. The compartmentalized container as recited in claim 1, wherein the top surface of the base includes an upper peripheral rim, wherein a bottom surface of an outwardly extending peripheral flange of the first reclosable lid abuts the upper peripheral rim of the top surface of the base.

12. The compartmentalized container as recited in claim 11, wherein a portion of a top surface of the first reclosable lid is recessed within the perimeter opening of the base with respect to the upper peripheral rim of the base.

13. The compartmentalized container as recited in claim 1, wherein a top surface of the first reclosable lid includes ribs raised with respect to the top surface of the first reclosable lid to assist with stacking containers together.

14. The compartmentalized container as recited in claim 13, wherein one or more bottom corners of the respective compartments are chamfered to improve stability when stacking the containers.

15. The compartmentalized container as recited in claim 1, further comprising a tamper-evident hinge joining the first reclosable lid with the base, the tamper-evident hinge including a frangible section.

16. The compartmentalized container as recited in claim 15, wherein the frangible section includes at least one line of weakness.

17. The compartmentalized container as recited in claim 16, wherein the frangible section includes two parallel lines of weakness defining a tear strip therebetween.

18. The compartmentalized container as recited in claim 1, wherein the first reclosable lid and the base are thermoformed from a single sheet of plastic.

19. The compartmentalized container as recited in claim 1, wherein the additional reclosable lid is one of a plurality of additional reclosable lids, wherein each of the plurality of additional reclosable lids encloses a respective compartment.

* * * * *